US012163705B2

(12) United States Patent
Hellmann

(10) Patent No.: US 12,163,705 B2
(45) Date of Patent: Dec. 10, 2024

(54) EJECTOR REFRIGERATION CIRCUIT

(71) Applicant: Carrier Corporation, Palm Beach Gardens, FL (US)

(72) Inventor: Sascha Hellmann, Hessen (DE)

(73) Assignee: CARRIER CORPORATION, Palm Beach Gardens, FL (US)

( * ) Notice: Subject to any disclaimer, the term of this patent is extended or adjusted under 35 U.S.C. 154(b) by 127 days.

(21) Appl. No.: 17/118,453

(22) Filed: Dec. 10, 2020

(65) Prior Publication Data

US 2021/0348810 A1 Nov. 11, 2021

(30) Foreign Application Priority Data

May 6, 2020 (EP) ..... 20173193

(51) Int. Cl.
*F25B 41/00* (2021.01)

(52) U.S. Cl.
CPC ..... *F25B 41/00* (2013.01); *F25B 2341/0012* (2013.01)

(58) Field of Classification Search
USPC ..... 62/115
See application file for complete search history.

(56) References Cited

U.S. PATENT DOCUMENTS 3,670,519 A * 6/1972 Newton ..... F25B 41/00 62/191
3,680,327 A * 8/1972 Stein ..... F25B 1/08 62/226
4,164,850 A * 8/1979 Lowi, Jr. ..... F25B 1/08 62/196.3
4,248,049 A * 2/1981 Briley ..... F24D 11/0221 62/235.1
4,342,200 A * 8/1982 Lowi, Jr. ..... F01P 9/06 60/599
4,854,725 A * 8/1989 Sims ..... G01N 25/60 73/61.41

(Continued)

FOREIGN PATENT DOCUMENTS

CN 100529588 C 8/2009
EP 0485185 A1 * 5/1992

(Continued)

OTHER PUBLICATIONS

JP 2014501381A, machine translation (Year: 2023).*

(Continued)

*Primary Examiner* — Len Tran
*Assistant Examiner* — Kirstin U Oswald
(74) *Attorney, Agent, or Firm* — CANTOR COLBURN LLP

(57) ABSTRACT

An ejector refrigeration circuit 1 including: a two-phase circuit 2 including: a heat rejection heat exchanger 12 including an inlet 12*a* and an outlet 12*b*; and an ejector 14 including a high pressure inlet 14*a*, a low pressure inlet 14*b* and an outlet 14*c*; the ejector high pressure inlet 14*a* is coupled to the heat rejection heat exchanger outlet 12*b*; and an evaporator 18 including an inlet 18*a* and an outlet 18*b*; the outlet 18*b* of the evaporator 18 is coupled to the low pressure inlet 14*b* of the ejector 14; and the ejector refrigeration circuit 1 further including a vapour quality sensor 20 positioned at the outlet 12*b* of the heat rejection heat exchanger 12.

11 Claims, 1 Drawing Sheet

(56) References Cited

U.S. PATENT DOCUMENTS 5,410,887 A * 5/1995 Urata ..... F25B 9/006 62/114
5,861,755 A * 1/1999 Moerk ..... G01N 27/221 73/19.1
6,779,360 B2 8/2004 Kawamura et al.
6,868,679 B2 3/2005 Yamaguchi et al.
6,871,506 B2 3/2005 Takeuchi et al.
6,941,768 B2 * 9/2005 Ikegami ..... F04F 5/04 62/511
7,059,150 B2 6/2006 Komatsu et al.
7,062,929 B2 6/2006 Nishida et al.
7,178,359 B2 2/2007 Oshitani et al.
7,870,758 B2 1/2011 Nishijima et al.
8,191,383 B2 6/2012 Ogata et al.
8,783,060 B2 7/2014 Nishijima et al.
9,752,801 B2 * 9/2017 Verma ..... F25B 1/06
9,759,462 B2 * 9/2017 Zou ..... F25B 9/008
10,323,863 B2 * 6/2019 Siegert ..... F25B 9/006
10,365,018 B2 * 7/2019 Scherer ..... F25B 49/02
2004/0007014 A1 * 1/2004 Takeuchi ..... F25B 41/34 62/500
2004/0055326 A1 * 3/2004 Ikegami ..... F04F 5/461 62/500
2004/0211199 A1 * 10/2004 Ozaki ..... F25B 41/00 62/170
2005/0028552 A1 * 2/2005 Nishijima ..... F25B 31/004 62/470
2006/0073010 A1 * 4/2006 Busekros ..... F01D 25/12 415/177
2006/0254308 A1 * 11/2006 Yokoyama ..... F25D 21/08 62/500
2010/0162751 A1 * 7/2010 Nishijima ..... F25B 1/10 62/500
2013/0042640 A1 2/2013 Higashiiue et al.
2013/0086930 A1 * 4/2013 Scherer ..... F25B 1/00 62/216
2013/0111935 A1 * 5/2013 Zou ..... F25B 6/04 62/502
2013/0125569 A1 * 5/2013 Verma ..... F25B 41/00 62/115
2016/0090995 A1 * 3/2016 Yamada ..... F25B 41/00 417/194
2016/0120019 A1 * 4/2016 Shedd ..... F25B 41/40 361/679.47
2016/0361677 A1 * 12/2016 Blackley ..... A61L 9/00
2017/0261245 A1 * 9/2017 Madsen ..... F25B 41/00
2017/0297416 A1 10/2017 Tashiro et al.
2018/0066872 A1 3/2018 Hellmann
2018/0142927 A1 5/2018 Hellmann et al.
2018/0231284 A1 * 8/2018 Prins ..... F25B 49/027
2019/0170384 A1 * 6/2019 McQuade ..... G05B 15/02
2019/0301773 A1 * 10/2019 Fredslund ..... F25B 1/10
2019/0301780 A1 * 10/2019 Schmidt ..... F25B 41/00
2020/0003456 A1 1/2020 Wang et al.
2020/0103151 A1 * 4/2020 Prins ..... F25B 49/02

FOREIGN PATENT DOCUMENTS

EP 2504640 B1 5/2013
EP 2718642 B1 9/2016
EP 2596303 B1 10/2016
EP 2661591 B1 10/2018
EP 3365619 B1 8/2019
JP 2008261590 A 10/2008
JP 4232567 B2 3/2009
JP 4804528 B2 11/2011
JP 2014501381 A * 1/2014
WO 2016180487 A1 11/2016

OTHER PUBLICATIONS

European Search Report for European Application No. 20173193.2; Report Mail Date Oct. 26, 2020 (pp. 1-26).
Elbel et al. "Experimental validation of a prototype ejector designed to reduce throttling losses encountered in transcritical R744 system operation", International Journal of Refrigeration, Amsterdam, NL vol. 31, No. 3, Mar. 6, 2008; pp. 411-422.

* cited by examiner

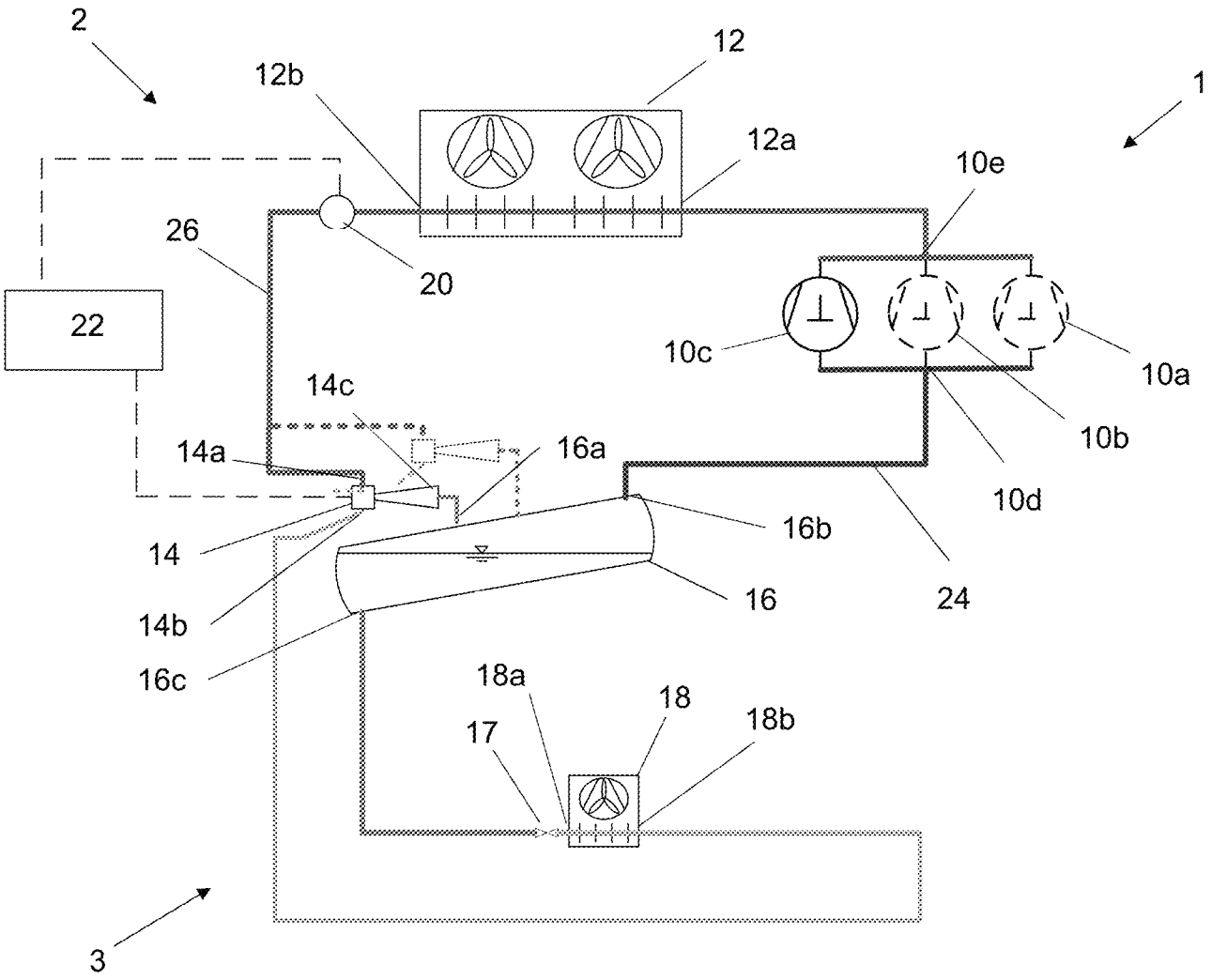
1
10a
10b
10d
10e
24
10c
16b
16
12a
12
18b
18
16a
18a
17
20
14c
12b
26
14a
14
14b
16c
22
2
3

EJECTOR REFRIGERATION CIRCUIT

CROSS-REFERENCE TO RELATED APPLICATIONS

This application claims priority to European Patent Application No. 20173193.2, filed May 6, 2020, the contents of which are incorporated by reference herein in their entirety.

BACKGROUND

This invention is related to an ejector refrigeration circuit, in particular to an ejector refrigeration circuit comprising a sensor for measuring the vapour quality.

In a refrigeration circuit an ejector may be used as an expansion device for the refrigerant. A typical refrigeration circuit comprises a compressor to raise the pressure of the refrigerant, typically in the gaseous phase. The refrigeration circuit further comprises a heat rejection heat exchanger/condenser for condensing the refrigerant to a liquid for it to then pass through an expansion device and heat absorption heat exchanger.

An ejector can be employed between the outlet of the condenser and the inlet of the evaporator. Ejectors comprise a primary high pressure inlet, a secondary low pressure inlet and an outlet. When an ejector is used as part of a refrigeration circuit, the cooled refrigerant from the condenser can enter the ejector at the high pressure inlet and is expanded to a lower pressure at the outlet of the ejector.

At the outlet of the ejector the refrigerant flow will typically be both liquid and gaseous phase. The gaseous phase will be fed back to the compressor, while the liquid phase is fed through another expansion valve and then the evaporator. The fluid that leaves the evaporator then flows to the low pressure inlet of the ejector. The liquid refrigerant is sucked through the expansion valve and the evaporator due to the pressure difference between the high pressure inlet and the outlet of the ejector.

For the system to operate effectively, this pressure difference between the high pressure inlet and the outlet of the ejector must be sufficient to draw the refrigerant fluid through the evaporator at the required pressure.

If the pressure difference drops below a certain level, the pressure uplift through the low pressure inlet of the ejector will also drop, or in some cases reduce to zero. A reduction in pressure uplift at the low pressure inlet results in a reduction in refrigerant being drawn through the evaporator which decreases the working efficiency of the refrigerant circuit.

It is therefore desirable to ensure constant flow through the evaporator by maintaining a required level of pressure drop in the ejector.

WO 2016/180487 discloses an ejector refrigerant circuit comprising a compressor, heat rejection heat exchanger/condenser, ejector circuit and evaporator. In order to ensure a constant flow of refrigerant through the evaporator a liquid pump is located between the ejector and the evaporator. The refrigerant circuit also comprises a bypass line allowing the refrigerant to bypass the pump when it is not required.

In operation, if the pressure drop in the ejector is not large enough to cause suction of refrigerant through the evaporator, the liquid pump is operated to increase the pressure of fluid and mass flow of refrigerant through the evaporator.

If the pressure drop in the ejector is sufficient for causing suction through the evaporator, a bypass valve is opened, and the refrigerant flows directly to the evaporator, bypassing the liquid pump.

SUMMARY

Viewed from a first aspect, there is provided an ejector refrigeration circuit comprising: a two-phase circuit including: a heat rejection heat exchanger comprising an inlet and an outlet, and an ejector comprising a high pressure inlet, a low pressure inlet and an outlet, wherein the ejector high pressure inlet is coupled to the heat rejection heat exchanger outlet; an evaporator comprising an inlet and an outlet, wherein the outlet of the evaporator is coupled to the low pressure inlet of the ejector; and wherein the ejector refrigeration circuit further comprises a vapour quality sensor positioned at the outlet of the heat rejection heat exchanger.

The ejector can operate effectively in transcritical conditions, however the pressure lift of the ejector is reduced in the subcritical state. To offset this reduction in pressure lift some prior art systems require a pump, as in WO 2016/180487, can be used to maintain the required pressure once the pressure drop falls below a certain level.

It has been found that a small amount of vapour in the system in subcritical conditions can increase the pressure lift of the ejector, without the need for a pump. Thus, a higher vapour quality leads to increased ejector efficiency. However, this results in an increase in the amount of vapour being handled by the compressors. Hence, more compressors may be required if the vapour quality is increased too much which could result in an overall reduction in working efficiency of the refrigeration circuit.

The optimum amount of vapour would be the amount sufficient to provide the increase in ejector pressure uplift so a pump is not required, but not have a significant impact on the operation of the compressor.

Refrigeration circuits typically use temperature and pressure sensors for monitoring the refrigerant and controlling the high pressure circuit accordingly. However, given that the flow in the high pressure circuit of the refrigeration circuit is two-phase, these sensors will not provide the necessary information to determine vapour quality.

The above proposed circuit solves this problem by providing a vapour quality sensor at the outlet of the heat rejection heat exchanger. The values recorded by the vapour quality sensor can be used to control the ejector, in particular the opening of the ejector, to ensure significant pressure drop is present to create sufficient pressure lift at the low pressure inlet.

By ensuring that sufficient pressure lift is provided, the refrigerant flow through the expansion valves and/or the evaporator can also be maintained at the required level without requiring an additional pump. The ejector refrigeration circuit of the first aspect may hence be without an additional pump for maintaining ejector pressure conditions. In some examples, the only pressure increasing devices within the refrigeration circuit may comprise the ejector (or multiple ejectors as discussed below) and a compressor device of the circuit, which may be a multistage or a parallel compression device.

Given that a pump is no longer required, the refrigeration circuit is simplified compared to conventional arrangements. This in turn can lead to a reduction in component costs, as well as maintenance time and costs leading to an overall reduction in operating costs and improvement in working efficiency.

The ejector refrigeration circuit may further comprise a compressor with an inlet and an outlet and a flash tank comprising an inlet, a liquid outlet and a gas outlet.

The ejector outlet may be coupled to the inlet of the flash tank. The flash tank gas outlet may be coupled to the inlet of the compressor. The outlet of the compressor may be coupled to the inlet of the heat rejection heat exchanger.

The ejector refrigeration circuit may further comprise an expansion valve. The inlet of the evaporator may be coupled to the liquid outlet to the liquid outlet of the flash tank via the expansion valve. Including an expansion valve allows the system to control the amount of refrigerant that is released into the evaporator. This helps to ensure that the optimum amount of liquid is provided to the evaporator and only vapour leaves the evaporator. Alternatively, the inlet of the evaporator may be coupled directly to the liquid outlet of the flash tank. The flow through the evaporator may be caused by the pressure uplift through the low pressure inlet of the ejector due to the pressure drop between the high pressure inlet and the outlet.

The vapour quality sensor may be an optical sensor, such as a camera or a microscope. Alternatively, the vapour quality sensor may be a dielectric sensor, such as a capacitance probe. As further alternatives, the vapour quality sensor may be a wire mesh sensor, and electrical resistance sensor, or an electrical impedance sensor. Multiple sensor types may optionally be included for redundancy and/or added accuracy.

The ejector may be a variable geometry ejector with one or more controllable parameters. The one or more controllable parameters may include for example high pressure inlet diameter, low pressure inlet diameter, outlet diameter, throat diameter, diffuser diameter, diffuser length, mixing chamber diameter. The one or more controllable parameters may be adjusted to alter the capacity of the ejector.

The one or more controllable parameters may be varied using one or more actuators and/or valves. The actuators may be electric, such as solenoid. Alternatively, the actuators may be pneumatic or hydraulic. The actuators may adjust the one or more controllable parameters by moving flow constrictors which adjust the diameter of the inlets and outlet. Alternatively, the throat or diffuser length may be adjusted by the actuators. The ejector may comprise a needle valve disposed within the inlet and a corresponding needle actuator. The needle actuator may move the tip of the needle valve into and out of the throat section to modify the diameter accordingly.

The refrigeration circuit may comprise a plurality of ejectors. The number of ejectors depends on the level of expansion required for the refrigerant. The level of expansion required can be determined by pressure sensors and temperature sensors, as well as the vapour quality sensors. This may be a set output for the overall ejector refrigeration circuit.

A plurality of ejectors may also provide one or more redundancies. Given the location of the ejector within the circuit, if it fails the entire circuit will also fail. The ejector refrigeration circuit may comprise one or more branching flow paths upstream of each of the inlets of each of the plurality of ejectors. Each of the one or more branching flow paths may divert from the high pressure circuit flow path at a branching point. Alternatively, each of the one or more branching flow paths may be connected directly to the outlet of the heat rejection heat exchanger.

In the event of one of the plurality of ejectors becoming blocked or failing by other means a valve may prevent flow to the failed ejector and may divert it to one of the other plurality of ejectors that is still operational.

This can help to ensure that the ejector refrigeration circuit remains operational at all times.

The plurality of ejectors may be connected in parallel so that each high pressure inlet is connected separately to the outlet of the heat rejection heat exchanger.

Each of the plurality of ejectors may be variable geometry ejectors. Each of the plurality of ejectors may be configured with different capacities. This will result in different pressure drops, and hence different pressure uplift, across each ejector, and thus provide greater scope for modifying the operating efficiency of the ejector.

Each of the plurality of ejectors may be non-variable ejectors. Each of the non-variable ejectors may be connected in parallel. Each of the plurality of ejectors may be configured with a separate flow valve which can control the amount of flow to the high pressure inlet of the corresponding ejector. The capacity of the plurality of ejectors may be modified by restricting flow through the valves for one or more of the plurality of ejectors. The use of valves and multiple ejectors allows for the capacity to be modified with non-variable ejectors.

Non-variable ejectors are advantageous as they comprise no moving parts. Thus they are less prone to malfunctioning and require less maintenance. However, they provide less scope for modifying the capacity than variable geometry ejectors. Furthermore, the capacity for a non-variable ejector can only be adjusted through the presence of additional ejectors, whereas the capacity of a variable geometry ejector can easily be modified with a single ejector.

The ejector refrigeration circuit may comprise a controller. The controller may receive signals from the vapour quality sensor. The controller may control the parameters of the variable geometry ejectors based on the signals form the vapour quality sensor. The controller may be configured to adjust the parameters of the variable geometry ejectors to ensure sufficient pressure drop across the ejector to provide sufficient suction through the evaporator.

Alternatively, the controller may be configured to restrict flow through one or more of the valves for the high pressure inlets on each of the plurality of non-variable ejectors. This can control the amount of flow to each ejector and be used to divert fluid away from ejectors which may have failed. Moreover, each ejector non-variable ejector may be set up with different parameters. Hence, the control may take account of the expansion requirement and adjust the flow to each accordingly.

A single controller may be configured to control the parameters for each of the plurality of variable geometry ejectors. Alternatively, each of the plurality of variable geometry ejectors may be controlled by a separate controller. Each individual controller may be controlled by a central processor. As further alternatives, a single controller may be configured to control all of the valves for each of the plurality of non-variable ejectors or a separate controllers are configured to control each of the valves.

The ejector refrigeration system may further comprise one or more temperature sensors and one or more pressure sensors. In addition to the vapour quality sensor, or as an alternative, the temperature sensors and/or pressure sensors may provide useful information.

The controller may be configured to further receive signals from the one or more temperature sensors and the one or more pressure sensors and modify the parameters of the variable geometry ejectors based on said signals.

The controller can also control the operation of the other components of the ejector refrigeration circuit, such as the compressor and expansion valve. For example, the controller can control the operation of the compressor based on the signals from the pressure sensor. In particular, the compressor unit may comprise a plurality of compressors. In circumstances where high compression is required, all of the plurality of compressors within the compressor unit may be active. Alternatively, if only a low compression is required only a small amount of the compressors may be activated.

In some cases the circuit between condenser outlet and the ejector may be single phase, wherein only liquid is present. In this case the pressure sensor and temperature sensor may be sufficient to provide the necessary information for optimising the parameters of the variable geometry ejectors. A single phase circuit may also apply to a circuit where only vapour is present.

However, as stated above, if a small amount of vapour remains in the circuit after the condenser, the ejector efficiency increases. Due to the presence of vapour in the circuit, a pressure sensor and temperature sensor are not sufficient to provide enough information and a further vapour quality measurement is required.

The two phase circuit between the condenser and the ejector may be a high pressure circuit. The majority of the refrigerant in the high pressure two phase circuit may be liquid at high pressure having flown through the compressor and the condenser.

The ejector refrigeration circuit may further comprise low pressure, low temperature circuit comprising the evaporator. The low temperature, low pressure circuit may further comprise an expansion valve, which may be in addition to the ejector.

The evaporator may comprise one or more fans. The fans promote the flow of air through the evaporator to increase the rate of heat absorption. The speed of the fans can be controlled by the controller and may depend on the required output for the ejector refrigeration circuit. The controller may be the same controller used for varying the ejector, or it may be separate controller.

The flash tank may comprise a liquid portion and a gaseous portion. The liquid portion and the gaseous portion may be separated by gravity. The flash tank gas outlet may be positioned near the top of the flash tank and may feed the compressor. The flash tank liquid outlet may be positioned near the bottom of the tank and feed the expansion valve and/or the evaporator.

When passing through the ejector, the resulting two-phase mixture may expand resulting in a drop in pressure and temperature. In the present system, a small amount of vapour is already present in the high pressure circuit which feeds into the ejector. However once passing through the ejector, a greater proportion of vapour may be present. Sending the vapour into the evaporator, along with the low temperature liquid refrigerant, can reduce the efficiency of the evaporator. This is due to a lower contact surface area between the liquid refrigerant and the surface of the evaporator coil. By including a flash tank, the vapour and liquid refrigerant can be separated and locating the liquid outlet, which feeds to the evaporator, near the bottom of the flash tank ensures that only liquid enters the evaporator. Thus the efficiency of the refrigeration circuit is improved further through the provision of the flash tank.

The required pressure drop across the ejector to provide sufficient uplift and suction through the evaporator may be between 0.2 and 4 bar, optionally between 1 and 2 bar, optionally, between 1.5 and 2 bar.

The ejector refrigeration circuit may be suitable for use with any type of refrigerant. The ejector refrigeration circuit may be suitable for use with carbon dioxide as the refrigerant. Alternative refrigerants used in the ejector refrigeration system may include Freon, CFCs, HCFCs and HFCs. The type of refrigerant selected will have an effect of the performance of the ejector refrigeration cycle. Each refrigerant may also vary in stability and flammability which may be an important consideration when selecting the refrigerant.

The ejector refrigeration circuit may be used in a variety of refrigeration applications. These may include domestic and commercial refrigeration such as those used for storing food and beverages in homes and shops. The ejector refrigeration circuit may further be used in cold storage and industrial refrigeration. Additionally, the ejector refrigeration circuit may be used for air conditioning.

Viewed from a second aspect, there is provided a method of operating an ejector refrigeration circuit, the ejector refrigeration circuit comprising: a controller; a two phase circuit comprising a heat rejection heat exchanger comprising an inlet and an outlet, and an ejector comprising a high pressure inlet, a low pressure inlet and an outlet, wherein the ejector high pressure inlet is coupled to the heat rejection heat exchanger outlet; an evaporator comprising an inlet and an outlet, wherein the outlet of the evaporator is coupled to the low pressure inlet of the ejector, and a vapour quality sensor positioned at the outlet of the heat rejection heat exchanger, wherein the method comprises monitoring the vapour quality in the two phase circuit; providing a signal to the controller indicative of vapour quality; and adjusting a capacity of the ejector in response to the signals indicative of the vapour quality in the two phase circuit.

The method may be used with an ejector refrigeration circuit as discussed above in relation to the first aspect and the circuit may include any or all of the further optional features discussed above.

The ejector may be a variable geometry ejector. The one or more parameters that are adjusted in response to the signals indicative of vapour quality may be one or more parameters of the variable geometry ejector.

The method may therefore comprise the step of adjusting one or more parameters of a variable geometry ejector. This can ensure that the require pressure drop is achieved to ensure sufficient pressure uplift at the low pressure outlet, and therefore sufficient suction through the evaporator.

The circuit may comprise a plurality of ejectors. The controller may control the operation of each of the plurality of ejectors. Alternatively, a plurality of controllers may control individual ejectors of the plurality of ejectors.

The one or more controllers may adjust the one or more parameters of the variable geometry ejectors through a series of actuators. Each actuator may move a separate part of the ejector.

The ejector circuit may comprise a plurality of non-variable ejectors. Each of the plurality of non-variable ejectors may have a respective flow valve upstream of the high pressure inlet. The method may comprise restricting flow through one or more of the flow valves in response to the signals from the vapour quality sensor.

The method may comprise using carbon dioxide as a refrigerant. Alternatively, Freon, CFCs, HCFCs or HFCs may be used as the refrigerant.

DRAWING DESCRIPTION

Example embodiments of the invention are described below by way of example only and with reference to the accompanying drawing.

FIG. 1 shows a schematic view of an ejector refrigeration circuit.

DETAILED DESCRIPTION

The ejector refrigeration circuit 1 shown in FIG. 1 comprises a high pressure, two phase circuit 2 and a low pressure, low temperature circuit 3. The high pressure, two phase circuit 2 comprises a one or more compressors 10*a*, 10*b*, 10*c* forming a compressor unit with an inlet 10*d* and an outlet 10*e*.

The outlet 10*e* of the compressors 10*a*, 10*b*, 10*c* of the compressor unit is fluidly connected to an inlet 12*a* of a heat refection heat exchanger 12. The heat rejection heat exchanger may also be referred to as a condenser 12. The outlet 12*b* of the condenser 12 is fluidly connected to a high pressure inlet 14*a* of an ejector 14.

The ejector further comprises a low pressure inlet 14*b* and an outlet 14*c*. The outlet 14*c* of the ejector is fluidly connected to an inlet 16*a* of a flash tank 16. The flash tank 16 comprises a liquid portion and a vapour portion, wherein the liquid portion and the vapour portion are separated by gravity due to the different densities of the fluids.

The flash tank 16 further comprises a vapour outlet 16*b* near the top of the flash tank and a liquid outlet 16*c* near the bottom of the flash tank 16.

The vapour outlet 16*b* of the flash tank 16 is fluidly connected to the inlet 10*d* of the compressor unit 10*a*, 10*b*, 10*c*. The liquid outlet 16*c* of the flash tank is fluidly connected to the inlet 18*a* of an evaporator 18 via an expansion valve 17. The outlet 18*b* of the evaporator 18 is fluidly connected to the low pressure inlet 14*b* of the ejector 14.

In operation a refrigerant, such as carbon dioxide, is circulated through the ejector refrigeration circuit. A low pressure vapour line 24 delivers the refrigerant to the compressor 18 in gaseous form. The compressor 18 increases the pressure of the refrigerant and delivers it to the condenser 12.

The condenser 12 is configured to transfer heat from the refrigerant to the environments, reducing the temperature of the refrigerant in the process. This reduction in temperature condenses the refrigerant from a vapour to a liquid. In conventional ejector refrigeration circuits, the refrigerant leaving the outlet 12*b* of the condenser 12 is single phase, liquid, refrigerant. However, in the embodiment shown in FIG. 1, the refrigerant leaving the outlet 12*b* of the condenser 12 is two phase, liquid and vapour refrigerant. The majority of the refrigerant is liquid, with a small amount of vapour remaining.

In the ejector refrigeration circuit 1 of FIG. 1, the condenser comprises two fans which are configured to blow air through the condenser to enhance heat transfer from the refrigerant to the environment. It will be appreciated that more or less than two fans can be present.

High pressure two phase line delivers the two phase fluid to the high pressure inlet 14*a* of the ejector 14 which is configured to expand the refrigerant to a lower pressure level.

In the ejector 14, the refrigerant enters through the high pressure inlet 14*a* and passes into a convergent section. It then passes through a throat section and then a divergent section at the outlet 14*c* of the ejector 14. The movements from the inlet section, through the throat and then to the divergent section increases the flow velocity and reduces the pressure of the refrigerant. The pressure drop in the refrigerant between the inlet 14*a* and the outlet 14*c* of the ejector 14 draws a secondary flow through the low pressure inlet 14*b*.

The low pressure, two phase, refrigerant leaves the ejector 14 via the outlet 14*c* and enters the flash tank 16 through the flash tank inlet 16*a*. Within the flash tank 16, the refrigerant is separated due to gravity into a liquid portion in the lower part of the flash tank 16 and a vapour portion in the upper part of the flash tank 16.

The refrigerant in the vapour portion of the flash tank 16 leaves via the vapour outlet 16*b* and is returned to the compressor unit 10*a*, 10*b*, 10*c*. Meanwhile, the refrigerant in the liquid portion leaves the flash tank 16 via the liquid outlet 16*c* and is delivered to the expansion valve 17 and then enters the evaporator 18. Depending on the level of expansion achieved by the ejector 14, the expansion valve 17 may not be necessary. In which case a by-pass line (not shown) can be employed.

In the evaporator 18, heat is transferred from the environment to the liquid refrigerant. This heat causes the refrigerant to vaporise, removing heat from the environment. The resulting refrigerant vapour leaves the evaporator 18 via the outlet 18*b* and is delivered to the low pressure inlet 14*b* of the ejector.

In operation, the pressure drop between the high pressure inlet 14*a* and outlet 14*c* of the ejector causes the refrigerant to be sucked from the flash tank 16 through the expansion valve 17 and evaporator 18 to the low pressure inlet 14*b*. This pressure drop must therefore be maintained at a required amount and so the efficiency of the ejector 14 must also be maintained at an optimum level.

In conventional systems, the refrigerant in the high pressure circuit 2 between the condenser 12 and the ejector 14 is single phase, liquid, refrigerant. However, having a small amount of vapour in the refrigerant leaving the condenser has been shown to improve the efficiency of the ejector 14.

However, this must be balanced with the compressor capacity as the more vapour that is present in the circuit, the more work there is to do for the compressors. This may result in more compressors being needed, which would increase the complexity of the refrigeration circuit and reduce the overall operating efficiency.

There is therefore an optimum amount of vapour, which results in a sufficient increase in the ejector efficiency, without having a significant impact on the compressor workload.

Conventional ejector refrigerant circuits comprise pressure and temperature sensors which are sufficient for single phase flow. However, given that the flow in the high pressure circuit 2 is two phase, pressure and temperature measurements alone do not provide adequate information to control the system accordingly.

The ejector refrigeration circuit 1 shown in FIG. 1 comprises a vapour quality sensor 20 at the outlet 12*b* of the condenser 12. The vapour quality sensor 20 may be an optical sensor such as a camera or a microscope. Alternative, the vapour quality sensor 20 may be a dielectric sensor such as a capacitance probe.

The ejector refrigeration circuit 1 further comprises a controller 22 configured to receive signals from the vapour quality sensor 20. The controller may also be configured to receive signals from the pressure and temperature sensors (not shown in the FIGURE).

Based on the signals received from the vapour quality sensor 20, the controller 22 is configured to adjust the capacity of the ejector 14 to maintain the optimum pressure drop to secure the required suction through the low pressure inlet 14*b* while keeping the amount of vapour to compressors to a minimum.

The ejector 14 may be a variable geometry ejector comprising one or more actuators for adjusting one or more parameters of the ejector. The actuators are configured to be controlled by the controller 22 based on the signals from the vapour quality sensor.

The ejector refrigeration circuit 1 may comprise a plurality of ejectors 14 depending on the required level of expansion. The plurality of ejectors 14 can be connected in parallel.

Each of the plurality of ejectors may be variable geometry ejectors each with one or more actuators for adjusting one or more parameters. The controller 22 may configure each ejector to have the same capacity. Alternatively, the controller 22 may configure each ejector 14 to have a different capacity. A flow valve may be located upstream of the high pressure inlet 14*a* of each ejector 14. The controller 22 may be configured to restrict the flow through one or more of the valves depending on the required capacity of the ejectors.

In an alternative arrangement, each of the plurality of ejectors 14 may be non-variable ejectors, each with a flow valve upstream of the high pressure inlet 14*a*.

The controller 22 can be configured to restrict flow through the one or more flow valves for each respective ejector 14 of the plurality of ejectors 14. This method can serve as an alternative way adjust the capacity of the ejectors based on the signals received from the vapour quality sensor, instead of using a variable geometry ejector.

The ejector refrigeration circuit 1 thus ensures optimum pressure drop to ensure sufficient suction through the expansion valve and evaporator, without the need for a pump as in conventional systems. This results in a simplified, more compact, circuit with lower maintenance costs.

What is claimed is:

1. An ejector refrigeration circuit comprising:

a circuit configured to operate as a two-phase circuit in use including: a heat rejection heat exchanger comprising an inlet and an outlet, and an ejector comprising a high pressure inlet, a low pressure inlet and an outlet, wherein the ejector high pressure inlet is coupled to the heat rejection heat exchanger outlet, and wherein the circuit is configured such that, in use, an amount of vapor is present in the circuit between the outlet of the heat rejection heat exchanger and the high pressure inlet of the ejector; and an evaporator comprising an inlet and an outlet, wherein the outlet of the evaporator is coupled to the low pressure inlet of the ejector; and wherein the ejector refrigeration circuit further comprises a vapor quality sensor positioned at the outlet of the heat rejection heat exchanger;

wherein the vapor quality sensor is an optical sensor, a camera, a microscope, a dielectric sensor, a capacitance probe, a wire mesh sensor, an electrical resistance sensor or electrical impedance sensor;

a controller configured to receive signals from the vapor quality sensor, wherein the controller is configured to adjust the capacity of the ejector based on the received signals to ensure that a required pressure uplift through the low pressure inlet of the ejector is achieved.

2. The ejector refrigeration circuit of claim 1, wherein the required pressure uplift at the low pressure inlet of the ejector is between 1 and 2 bar.

3. The ejector refrigeration circuit of claim 1, wherein the ejector refrigeration circuit comprises a plurality of ejectors connected in parallel.

4. The ejector refrigeration circuit of claim 1, wherein the ejector is a variable geometry ejector with one or more controllable parameters.

5. The ejector refrigeration circuit of claim 4, wherein the one or more controllable parameters are modified using one or more actuators controlled by the controller.

6. The ejector refrigeration circuit of claim 1, wherein the ejector is a non-variable ejectors each with a flow valve upstream of the high pressure inlet.

7. The ejector refrigeration circuit of claim 6, wherein the controller is configured to control the flow through the one or more of the flow valves.

8. A method of operating an ejector refrigeration circuit, the ejector refrigeration circuit comprising:

a controller;

a circuit configured to operate as a two phase circuit in use comprising a heat rejection heat exchanger comprising an inlet and an outlet, and an ejector comprising a high pressure inlet, a low pressure inlet and an outlet, wherein the ejector high pressure inlet is coupled to the heat rejection heat exchanger outlet, and wherein the circuit is configured such that, in use, an amount of vapor is present in the circuit between the outlet of the heat rejection heat exchanger and the high pressure inlet of the ejector;

an evaporator comprising an inlet and an outlet, wherein the outlet of the evaporator is coupled to the low pressure inlet of the ejector, and a vapor quality sensor positioned at the outlet of the heat rejection heat exchanger, wherein the method comprises monitoring the vapor quality in the two phase circuit;

providing a signal to the controller indicative of vapor quality; and the controller adjusting a capacity of the ejector in response to the signals indicative of the vapor quality in the two phase circuit to ensure that a required pressure uplift through the low pressure inlet of the ejector is achieved;

wherein the vapor quality sensor is an optical sensor, a camera, a microscope, a dielectric sensor, a capacitance probe, a wire mesh sensor, an electrical resistance sensor or electrical impedance sensor.

9. The method of claim 8, wherein the ejector is a variable geometry ejector with one or more controllable parameters, wherein the controller adjusts the one or more controllable parameters using one or more actuators to adjust the capacity of the ejector.

10. The method of claim 8, wherein the ejector refrigeration circuit comprises a plurality of ejectors connected in parallel.

11. The method of claim 10, wherein each of the plurality of ejectors are non-variable ejectors each having a respective flow valve positioned upstream of the high pressure inlet of the ejector, wherein the controller controls the flow through the one or more flow valves to adjust the overall output of the ejectors.

* * * * *